US010663202B2

(12) United States Patent
Zhen

(10) Patent No.: US 10,663,202 B2
(45) Date of Patent: May 26, 2020

(54) MODULAR MOLD FOR MAKING HOLLOW ICE BRICK

(71) Applicant: Shihua Zhen, Regina (CA)

(72) Inventor: Shihua Zhen, Regina (CA)

( * ) Notice: Subject to any disclaimer, the term of this patent is extended or adjusted under 35 U.S.C. 154(b) by 240 days.

(21) Appl. No.: 15/760,977

(22) PCT Filed: Oct. 10, 2015

(86) PCT No.: PCT/CN2015/091593
§ 371 (c)(1),
(2) Date: Mar. 16, 2018

(87) PCT Pub. No.: WO2017/045231
PCT Pub. Date: Mar. 23, 2017

(65) Prior Publication Data

US 2018/0252455 A1 Sep. 6, 2018

(30) Foreign Application Priority Data

Sep. 18, 2015 (CN) ..... 2015 2 0728889 U

(51) Int. Cl.
*F25C 1/22* (2018.01)

(52) U.S. Cl.
CPC ..... *F25C 1/22* (2013.01)

(58) Field of Classification Search
CPC ..... F25C 1/22; F25C 1/04; B25C 2500/00; A23G 1/005; A23G 1/20; A23G 9/083;
(Continued)

(56) References Cited

U.S. PATENT DOCUMENTS 802,848 A * 10/1905 Dunn ..... B29C 45/43 249/66.1
3,129,568 A 4/1964 Knepper
(Continued)

FOREIGN PATENT DOCUMENTS

CN 2771768 4/2006
JP 0007043056 2/1995
(Continued)

*Primary Examiner* — Leith S Shafi
(74) *Attorney, Agent, or Firm* — Kyle R. Satterthwaite; Ryan W Dupuis; Ade & Company Inc.

(57) ABSTRACT

A modular mold for making a hollow ice brick includes an external mold (1) and a mold core (2). The external mold (1) is a container that is formed by a bottom plate (11) and an enclosure wall (12) and that has an opening at the top thereof. The mold core (2) is located on the bottom plate (11) of the external mold (1). The bottom plate (11) and the enclosure wall (12) of the external mold (1) as well as the mold core (2) are spliced by modular mold sheets (3). The ice making mold adopts a modular design, is spliced by mold sheets and can be quickly assembled, and molds of different shapes and sizes can be formed according to requirements of a user. The formed mold includes the external mold (1) and the mold core (2); after a liquid is added in the external mold (1), a hollow ice brick can be formed when the external mold (1) is placed in a cold place. Before an ice brick is formed, the thickness of an ice layer in the hollow ice brick can be adjusted by regulating the distance between the mold core (2) and an inner wall of the external mold (1). The mold is a dedicated ice making mold, has a simple structure, can be combined more conveniently because of the modular design, and provides more sizes and shapes that can be selected by users, such that the mold is convenient and practical.

8 Claims, 2 Drawing Sheets

(58) Field of Classification Search
CPC ..... A23G 9/221; A21B 3/133; A21B 3/137; A21B 3/131; B28B 23/00; B28B 7/28
USPC ..... 249/58, 63–64, 66.1, 118, 122–125, 134, 249/136, 142–153, 175, 177, 183, DIG. 1; 425/185, 187, 189, 296, 318, 439, 425/436 RM, 436 R; 426/389, 414, 426/512–517; 99/426–442
See application file for complete search history.

(56) References Cited

U.S. PATENT DOCUMENTS 3,537,677 A * 11/1970 Cotton ..... B29C 33/405 249/83
4,732,397 A * 3/1988 Gavin ..... F16L 41/03 277/606
4,809,502 A * 3/1989 Iida ..... F01N 3/05 60/316
6,196,517 B1 * 3/2001 Westhoff ..... B28B 7/002 249/175

FOREIGN PATENT DOCUMENTS

RU 54154 6/2006
RU 84421 7/2009
SU 1090990 5/1984

* cited by examiner

MODULAR MOLD FOR MAKING HOLLOW ICE BRICK

TECHNICAL FIELD

The present invention relates to ice making molds, and more particularly to a modular mold for making hollow ice bricks.

BACKGROUND ART

In some cold countries or areas, making ice sculpture and ice bricks outdoors is a popular way of entertainment. Lighting decorations can be placed within hollow ice sculpture works; accordingly, after turned on, the lighting decorations make the ice sculptures more fantastic and attractive. Such that the decorativeness of the ice sculptures is improved, and the ice sculptures become excellent decorations.

An invention patent entitled "Molding Mode for Making Hollow Ice Method of Use Thereof", which has the patent number CN102230707A, discloses a method for making hollow ice sculptures using an inflated inner mold and a water injection outer mold.

In the production of the ice bricks in simple geometric shapes, people usually use the common tool that is not a dedicated mold, rather a simple container, such as a barrel shaped container, a box shaped container, and the like. Water is loaded into the container, and after the water is frozen into ice, the formed ice is taken out from the container, such that an ice brick in a certain geometric shape is prepared. However, since a non-dedicated tool is used to make the ice brick, the foregoing ice brick preparation approach has the following disadvantages: 1. it has difficulties to make a hollow ice brick; 2. after the water is frozen, the formed ice is stuck with the container, which makes it difficult to remove the ice brick from the container, and the container may be damaged when the ice brick is taken out therefrom; 3. the shape and size of the container are fixed, thus such tool can only be used to make the ice bricks always have the same shape and size, that is to say, the function of the tool is limited.

SUMMARY OF INVENTION

To overcome the deficiencies of the prior art, an object of the present invention is to provide a modular mold for making hollow ice bricks.

The technical solution adopted by the present invention for solving the technical problem is as follows:

A modular mold for making a hollow ice brick includes an external mold and a mold core, the external mold is a container that is formed by a bottom plate and an enclosure wall and that has an opening at the top thereof, the mold core is located on the bottom plate of the external mold, and the bottom plate and the enclosure wall of the external mold as well as the mold core are spliced by modular mold sheets.

As a further improvement of the foregoing technical solution, the inner wall of the external mold and an outer surface of the mold core are covered with a cold-resistant and waterproof plastic film. The plastic film can separate the mold from water. When the water is frozen, the formed ice will not attach to the mold so as to reduce the difficulty of stripping the mold. In addition, the plastic film is preferably a film made of TPU, which has the characteristics of being waterproof, cold-resistant and easy-folding, and has elasticity, so as to be well adapted to the volume change after water becomes ice, and is not easily damaged.

As a further improvement of the foregoing technical solution, the mold core is in a three-dimensional geometric shape and has an opening at the bottom thereof, and the top of the mold core is not higher than the enclosure wall of the external mold.

As a further improvement of the foregoing technical solution, a modular pulling ring for pulling out the mold core is provided inside the mold core. After an ice brick is formed, the mold core is located inside the formed ice brick, which is difficult to remove. The setting of the pulling ring makes it easy for a user to remove the mold core by applying force on the pulling ring.

As a further improvement of the foregoing technical solution, the pull ring is mounted inside the mold core through a screw. The pulling ring is not mounted until the mold core needs to be removed from the formed ice brick, the pulling ring will be mounted to the mold core.

As a further improvement of the foregoing technical solution, the mold sheets are spliced through a cooperating buckling structure or spliced by screws. The splicing process is easy and convenient, so as to achieve a quick assembly.

As a further improvement of the foregoing technical solution, the mold sheets include planar mold sheets and three-dimensional mold sheets, in which the planar mold sheets are used to prepare the bottom plate, the enclosure wall and the mold core; while the three-dimensional mold sheets are used to prepare the enclosure wall and the mold core.

As a further improvement of the foregoing technical solution, the shape of the planar mold sheets is one or more selected from the group consisting of polygons, circles, and ellipses, in which the polygons can be triangles, squares, rectangles, hexagons, stars and the like; the shape of the three-dimensional mold sheets is one or two selected from arcs and cylinders, which can be used as the side wall of a cylinder or an elliptical cylinder, or used as a circular dome for the mold core.

The beneficial effects of the present invention are as follows:

The ice making mold of the present invention adopts a modular design, is spliced by mold sheets and can be quickly assembled, and molds of different shapes and sizes can be formed according to the requirements of a user. The formed mold includes the external mold and the mold core; after a liquid is added in the external mold, a hollow ice brick can be formed when the external mold is placed in a cold place. Before an ice brick is formed, the thickness of an ice layer in the hollow ice brick can be adjusted by regulating the distance between the mold core and an inner wall of the external mold. The mold is a dedicated ice making mold, has a simple structure, can be combined more conveniently because of the modular design, and provides more sizes and shapes that can be selected by users, such that the mold is convenient and practical.

BRIEF DESCRIPTION OF THE DRAWINGS

The present invention will be further described in reference to the accompanying drawings and examples.

DESCRIPTION OF EMBODIMENTS

Figure 1:
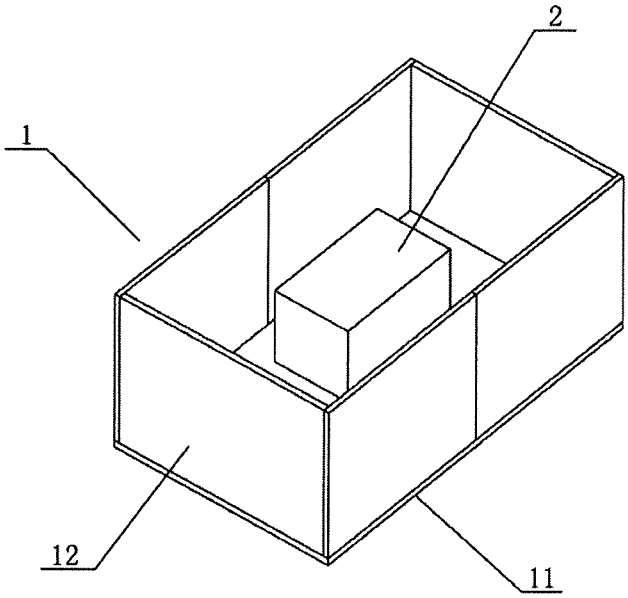
FIG. 1 is a schematic view of the structure of a preferred embodiment of the present invention.
Figure 2:
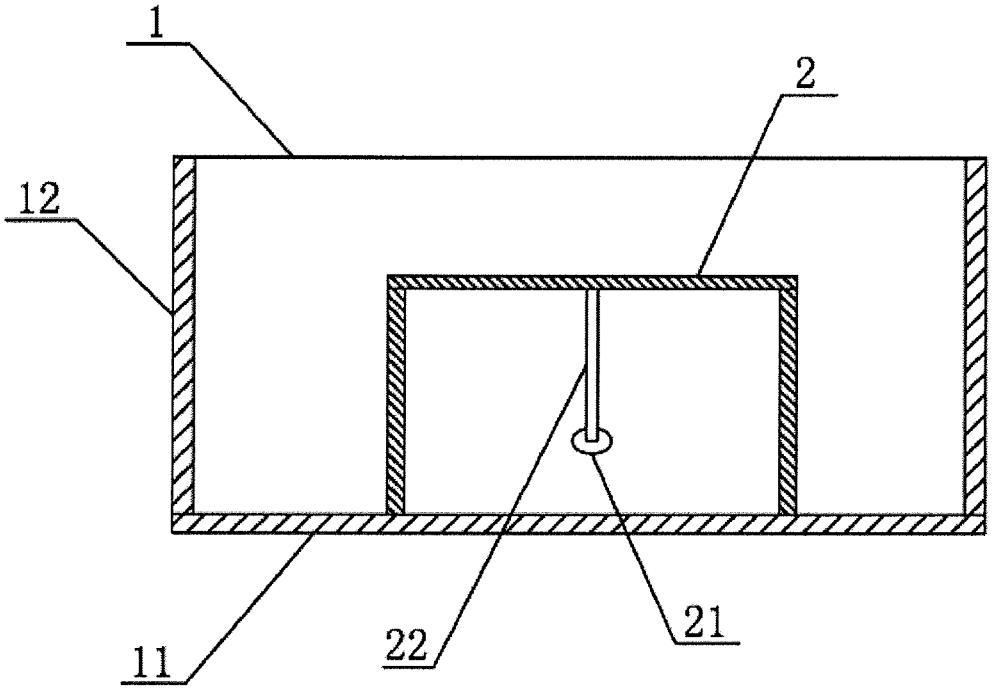
FIG. 2 is a sectional view of the foregoing example.
Figure 3:
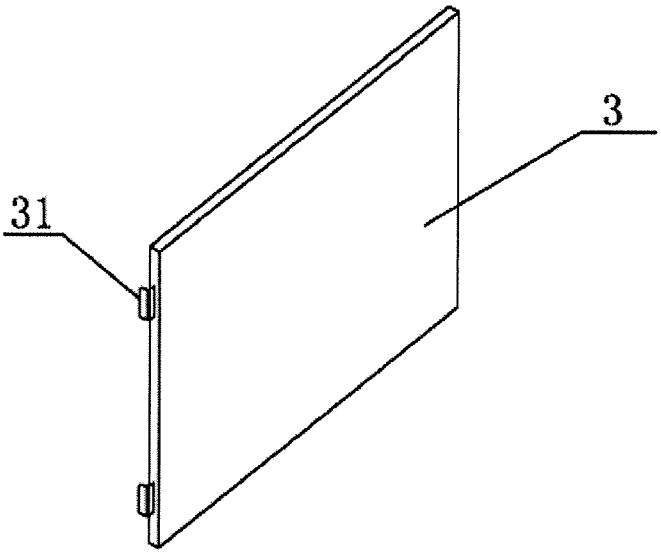
FIG. 3 is a schematic view of the structure of a planar mold sheet.

In reference to FIGS. 1 to 3, the present invention provides a modular mold for making a hollow ice brick, which includes an external mold 1 and a mold core 2, the external mold 1 is a container that is formed by a bottom plate 11 and an enclosure wall 12 and that has an opening at the top thereof, the mold core 2 is in a three-dimensional geometric shape and has an opening at the bottom thereof. The mold core 2 is located on the bottom plate of the external mold; in addition, the top of the mold core 2 is not higher than the enclosure wall 12 of the external mold 1. The bottom plate 11 and the enclosure wall 12 of the external mold 1 as well as the mold core 2 are spliced by modular mold sheets. The mold sheets 3 include planar mold sheets and three-dimensional mold sheets, where the shape of the planar mold sheets can be triangular, square, rectangular, hexagonal, star-shaped, circular, elliptical, and the like. The mold sheet 3 shown in FIG. 3 is a rectangular planar mold sheet. The planar mold sheet may serve as the bottom plate 11, the enclosure wall 12 and the mold core 2 to form the external mold 1 and the mold core 2 in a variety of different shapes. As shown in FIG. 1, planar mold sheets are used to form the most common rectangular shaped external mold 1 and mold core 2 for making rectangular hollow ice bricks. Moreover, the shape of the three-dimensional mold sheets can be arcs and cylinders, etc. The three-dimensional mold sheets can be used to make the enclosure wall 12 and the mold core 2, such as the side wall of a cylinder or an elliptical cylinder, or used as a circular dome for the mold core 2. The mold sheets 3 are spliced through a cooperating buckling structure 31; alternatively, the mold sheets 3 can be spliced by screws or connected via a fitting connection between projections and the grooves. The ice making mold of the present invention, which adopts a modular design, is spliced by mold sheets 3 and can be quickly assembled, and molds of different shapes and sizes can be formed according to the requirements of a user. The formed mold includes the external mold 1 and the mold core 2; after a liquid is added in the external mold 1, a hollow ice brick can be formed when the external mold 1 is placed in a cold place. Before an ice brick is formed, the thickness of an ice layer in the hollow ice brick can be adjusted by regulating the distance between the mold core 2 and an inner wall of the external mold 1.

Further, the inner wall of the external mold 1 and an outer surface of the mold core 2 are covered with a cold-resistant and waterproof plastic film. The plastic film can separate the mold from water. When the water is frozen, the formed ice will not attach to the mold so as to reduce the difficulty of stripping the mold. In addition, the plastic film is preferably a film made of TPU, which has the characteristics of waterproof, cold-resistant and easy-folding, and has elasticity, so as to be well adapted to the volume change after water becomes ice, and is not easily damaged.

Moreover, after an ice brick is formed, the mold core is located inside the formed ice brick, which is difficult to remove. In order to facilitate a user to remove the mold core 2, a modular pulling ring 21 is provided inside the mold core 2. The pull ring 21 is mounted inside the mold core 2 through a screw 22. The pulling ring 21 is not mounted until when the mold core 2 needs to be removed from the formed ice brick, the pulling ring 21 will be mounted to the mold core 2. The setting of the pulling ring 21 makes it easy for a user to remove the mold core by applying force thereon.

In the present invention, the mold is a dedicated ice making mold, has a simple structure, can be combined more conveniently because of the modular design, and provides more sizes and shapes that can be selected by users, such that the mold is convenient and practical.

The foregoing descriptions are merely some preferred embodiments of the present invention. The present invention is not limited to the above embodiments. As long as the technical effects of the present invention are achieved by the same means, it should fall within the protection scope of the present invention.

The invention claimed is:

1. A modular mold for making a hollow ice brick, characterized in that the modular mold comprises: an external mold (1) and a mold core (2), the external mold (1) is a container that is formed by a bottom plate (11) and an enclosure wall (12) and that has an opening at the top thereof, the mold core (2) is located on the bottom plate (11) of the external mold (1), and the bottom plate (11) and the enclosure wall (12) of the external mold (1) are spliced by modular mold sheets (3), characterized in that the modular mold further comprises a pulling member, attached to the mold core independently of the external mold, at a position residing entirely within the external mold during formation of the hollow ice brick, said pulling member being configured for manual pulling of the mold core from the hollow ice brick once formed.

2. The modular mold for making a hollow ice brick according to claim 1, characterized in that: an inner wall of the external mold (1) and an outer surface of the mold core (2) are covered with a cold-resistant and waterproof plastic film.

3. The modular mold for making a hollow ice brick according to claim 2, characterized in that: the mold core (2) is in a three-dimensional geometric shape and has an opening at the bottom thereof, and the top of the mold core (2) is not higher than the enclosure wall (12) of the external mold (1).

4. The modular mold for making a hollow ice brick according to claim 3, characterized in that: the pulling member comprises a pulling ring (21) provided inside the mold core for said manual pulling out the mold core (2) from the hollow ice brick once formed.

5. The modular mold for making a hollow ice brick according to claim 4, characterized in that: the pulling ring (21) is mounted inside the mold core (2) through a screw (22).

6. The modular mold for making a hollow ice brick according to claim 2, characterized in that: the mold sheets (3) are spliced through a cooperating buckling structure or spliced by screws.

7. The modular mold for making a hollow ice brick according to claim 6, characterized in that: the mold sheets (3) comprise planar mold sheets and three-dimensional mold sheets.

8. The modular mold for making a hollow ice brick according to claim 6, characterized in that: the shape of the planar mold sheets is one or more selected from the group consisting of polygons, circles, and ellipses, and the shape of the three-dimensional mold sheets is one or two selected from arcs and cylinders.

* * * * *